United States Patent [19]

Grechanliisky et al.

[11] 4,352,465

[45] Oct. 5, 1982

[54] DEVICE FOR MANUFACTURING RESISTORS FROM INSULATED WIRE

[76] Inventors: Stepan S. Grechanliisky, ulitsa Akademiches-kaya, 8/2, kv. 15; Ivan I. Grishanov, ulitsa Kommuny, 11, kv. 42; Sergei N. Dimitraki, ulitsa Bubnovskogo, 5/5, kv. 118; Vladimir S. Miroshnichenko, ulitsa Belskogo, 24, kv. 25; Vitaly I. Nastas, ulitsa Frunze, 104, all of Kishinev, U.S.S.R.

[21] Appl. No.: 205,446

[22] PCT Filed: Jan. 8, 1980

[86] PCT No.: PCT/SU80/00002

§ 371 Date: Sep. 8, 1980

§ 102(e) Date: Aug. 29, 1980

[87] PCT Pub. No.: WO80/01430

PCT Pub. Date: Jul. 10, 1980

[30] Foreign Application Priority Data

Jan. 8, 1979 [SU] U.S.S.R. ..... 2700553

[51] Int. Cl.[3] ..... H01C 17/00; H01C 17/22; H01F 41/04

[52] U.S. Cl. ..... 242/7.12; 242/7.03; 324/62

[58] Field of Search ..... 242/7.03, 7.12; 29/593, 29/605, 618; 324/62

[56] References Cited

U.S. PATENT DOCUMENTS 2,725,199 11/1955 Bower ..... 242/7.12

FOREIGN PATENT DOCUMENTS 222555 7/1968 U.S.S.R. ..... 242/7.12
246639 9/1969 U.S.S.R. .
246640 9/1969 U.S.S.R. .
255412 3/1970 U.S.S.R. .
408380 12/1973 U.S.S.R. ..... 242/7.12
588508 1/1978 U.S.S.R. ..... 324/62

OTHER PUBLICATIONS

"*Periodic Comparison Measuring Instruments*", P. P. Ornatski et al., Energiya, Moscow, 1975, see pp. 31–32.

*Primary Examiner*—Billy S. Taylor
*Attorney, Agent, or Firm*—Lilling & Greenspan

[57] ABSTRACT

A device for manufacturing resistors from insulated wire comprises a mechanism for taking up a wire unwound from a resistor being manufactured, the resistor being installed in a securing mechanism. Current output and input electrodes provide resistive and capacitive coupling between the unwound wire, a measuring circuit and a harmonic generator. An emitter follower is connected via its potential input to the electric contact element of the securing mechanism and via its output to the potential input of a phase-inverting amplifier whose output is loaded into a clamping amplifier. A precision voltage divider has one of its poles connected through a reference resistor to the electric contact element of the takeup mechanism. A common tap of the precision divider and the electric contact element are connected to a phase-sensitive indicator through a differential amplifier having a high-resistance input, the reference-signal inputs of said phase-sensitive indicator being coupled to the outputs of the clamping amplifier, while the output thereof is connected through a control unit to the drive kinematically coupled to the wire takeup mechanism.

3 Claims, 4 Drawing Figures

DEVICE FOR MANUFACTURING RESISTORS FROM INSULATED WIRE

FIELD OF THE INVENTION

The present invention relates to production of precision radio components and in particular to devices for manufacturing resistors from insulated wire.

DESCRIPTION OF THE PRIOR ART

Known in the art is a device utilized at a final stage of manufacturing resistors from microwire, when a wound resistor is adjusted to comply with the rating (cf. USSR Inventor's Certificate No. 246,639, Cl. H21C 54/01 published in "Bulletin of Inventions, Industrial Standards, and Trade Marks", No. 21, 1969, in Russian).

The aforesaid device comprises a unit for measuring resistance of a resistor being adjusted and a mechanism for breaking glass insulation of wire, which represents a cone roller on a support plate, said roller being kinematically coupled to a drive controlled by the unit for measuring resistance of a resistor being adjusted.

The application of the foregoing device is generally limited; a disadvantage associated with the fact that it is impossible to provide a stable electrical contact between a damaged microwire and such electrically conductive parts as a support plate and a roller, and also between said wire and the resistance measuring unit over a wide range of microwire resistance ratings since insulation splinters damage the wire conductor. A stable electrical contact may be provided only for microwires having a linear resistance not in excess of 2 kilohms per meter.

Furthermore, stringent requirements are placed upon surface roughness of a support plate and a roller in production and service. The surfaces of said parts are readily contaminated with splinters of broken insulation, and an oxide film appears thereon, a feature degrading further the performance of the device.

Also known in the art is a device for executing a method of adjusting wire-wound resistors (cf. USSR Inventor's Certificate No. 246,640, Cl. H21C 54/01 published in "Bulletin of Inventions, Industrial Standards, and Trade Marks," No. 21, 1969, in Russian).

The device for executing the known method of production of resistors, more particularly resistance adjustment for compliance with the rating, involves no destruction of insulation of excess wire unwound from the resistor being manufactured. In the circuit of the device the resistor being adjusted and the resistance of wound wire form arms of a measuring bridge circuit wherein the other two arms are formed by resistance boxes, namely by a resistance box mounting a reference resistor whose resistance is equal to the resistance rating for the resistor being manufactured, and by a resistance box having resistance equal to resistance of a length of wire unwound from the resistor being adjusted. Such a circuit also contains an a-c voltage source connected at opposite junctions of the measuring bridge circuit, and a null indicator.

However, the foregoing device does not permit high-accuracy production of resistors whose resistance rating exceeds 10 megohms, a disadvantage associated with the fact that the resistor being manufactured is inserted in the measuring circuit and pertinent measurements involve the use of a-c voltage. The reactive component of the resistor and the unwound length of wire increases with the resistance rating and may not, therefore, be accounted for in measurements.

Moreover, the operational efficiency of the device is reduced due to the need for having two measurements with alternating and direct currents.

The closest prior art reference is a device for automatic monitoring of wire-wound coils during a winding process without damage to insulation (cf. USSR Inventor's Certificate No. 255,412, Cl. H01 54/01 published in "Bulletin of Inventions, Industrial Standards, and Trade Marks", No. 33, 1969, in Russian).

The aforesaid device comprises a mechanism for taking up wire unwound from a feed spool and a mechanism for securing the feed spool with the wire, said mechanisms incorporating electric contact elements, current output and input electrodes providing capacitive coupling between insulated wire and the circuit, a harmonic generator coupled to the wire through the current input electrode, a precision voltage divider, a reference resistor, a phase-inverting electronic amplifier having its input connected to the current output electrode and its output connected to one of the poles of the precision divider and to one of the poles of the reference resistor whose other pole is coupled to the electric contact element of the wire takeup mechanism. The second pole of the precision divider is connected to the common wire of the device. The device also includes a phase-sensitive null indicator whose inputs are connected with a common tap of the precision divider and with the contact element of the wire takeup mechanism.

In the aforesaid device the frame of the resistor being manufactured is secured to the wire takeup mechanism whereupon wire is wound onto the frame of the resistor being manufactured. To wind the wire, the resistor being manufactured is inserted in the measuring bridge circuit along with the reference resistor and the precision divider.

However, the known device provides winding of wire-wound resistors with an error of about 2%. It may not assure full compliance with the rating since the current output electrode represents capacitance formed by an electrically conductive spool and wire wound thereon or capacitance between wire on a nonconductive surface of the spool and an electrically conductive medium wherein the spool is immersed in winding the wire. A capacitive current output contact at low frequencies of measured voltage represents resistance, a limitation decreasing sensitivity of the measuring circuit, reducing its noise immunity, and calling for the inclusion in the circuit of a phase-inverting amplifier with an input impedence exceeding reasonable limits. In the event of winding the wire onto the spool made of a nonconductive material, it is immersed in an electrically conductive medium which may not be easily removed thereafter from the winding of the resistor being manufactured. Furthermore, it increases reactance and causes deviation of resistor values from corresponding ratings during a drying process. Also, the electrically conductive medium and subsequent drying of the resistor result in the appearance of the strain effect in the wire and in the redistribution of stresses within the winding, a limitation being one of the causes of winding breaks.

In the known device the resistor being manufactured is installed in the wire takeup mechanism forming a measured arm of the measuring bridge circuit. Since in this case measurements involve the use of alternating current, the maximum possible resistance of the resistor being manufactured may not exceed 10 megohms. With higher resistance ratings, reactance of the resistors drastically manifests itself, a disadvantage causing great errors in resistance measurements and, hence, in production of resistors.

SUMMARY OF THE INVENTION

The invention resides in providing a device for manufacturing resistors from insulated wire allowing semiautomatic adjustment of a resistor being manufactured to a practicable accuracy due to continuous monitoring of resistance of wire unwound from the resistor being manufactured and incorporating a measuring circuit which assures high-accuracy measurements of resistance of unwound wire owing to exclusion therefrom of the manufactured resistor whose reactance is the principal cause of a measuring error in production.

The foregoing object is accomplished by a device for manufacturing resistors from insulated wire comprising a mechanism for taking up unwound insulated wire with electric contact elements and a drive, a mechanism for securing a feed spool with an electric contact element, a current output electrode and a current input electrode. Capacitive coupling is provided between the conductor of the unwound wire and a harmonic generator. A reference resistor has one pole connected to the electric contact element and the other pole to a precision voltage divider. A phase-sensitive indicator, affecting the drive of the wire takeup mechanism, is electrically coupled via its input to the contact element of the wire takeup mechanism and to a common tap of the precision divider. A phase-inverting amplifier has an output connected to the remaining pole of the reference resistor and to the precision voltage divider. According to the invention, an electronic follower is inserted between the contact element of the securing mechanism, and the potential input of the phase-inverting amplifier, a clamping amplifier has a potential input connected to the output of the phase-inverting amplifier and an output connected to the phase-sensitive indicator; a differential amplifier has a high-resistance input and is placed between the signal input of the phase-sensitive indicator, the contact element of the wire takeup mechanism, and the common tap of the precision divider. The current output electrode represents a galvanic contact of the conductor of the unwound wire with the electric contact element of the securing mechanism.

To ensure inertialess unwinding of the wire and preclude the strain effect, a wire receiver of the wire takeup mechanism comprised in the hereinproposed device for manufacturing resistors preferably represents a console with a shaft passed therethrough, which is installed in a manner allowing its rotation in the wire receiver, the free end of the shaft mounting a wire layer comprising a tore structure.

To provide a capacitive contact between the unwound wire and the current input electrode, it is advantageous that said current input electrode should represent a mental bar with a groove and the internal surface of the groove should be coated with a layer of insulation, said bar having on the side of the wire takeup mechanism a wire position stabilizer representing a spiral.

The device for manufacturing resistors from insulated wire in compliance with the invention allows fabrication of resistors over a wide range of resistance ratings with a resistance rating production error not in excess of 0.01% due to omission of the resistor being manufactured from the measuring circuit and reduction of resistances of the reference resistor and the resistor being manufactured, its function in the hereinproposed device being performed by excess wire unwound from the resistor being manufactured. Also, a lesser resistor production error is obtained by utilizing the current output electrode representing a galvanic contact of the wire conductor of the item being manufactured with the electric contact element of the securing mechanism, the associated advantages over the prior art being a shorter time required to manufacture high megohmic resistors and the possibility of high-accuracy semiautomatic fabrication.

BRIEF DESCRIPTION OF THE DRAWINGS

The invention will now be described further with reference to specific embodiments thereof, taken in conjunction with the accompanying drawings, wherein.

DETAILED DESCRIPTION OF THE INVENTION

Figure 1:
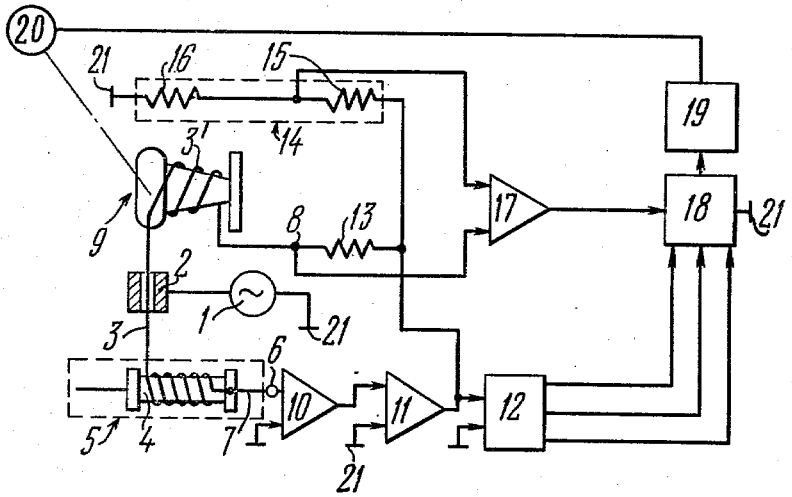
FIG. 1 is a block diagram of a device for manufacturing resistors from insulated wire according to the invention.

Referring to the block diagram of FIG. 1 the device for manufacturing resistors from insulated wire comprises a harmonic generator 1 whose potential output is connected to a current input electrode 2 through which a wire 3 unwound from a resistor 4 being manufactured is passed (said resistor representing a feed spool in the preferred embodiment of the invention). The resistor 4 being manufactured is installed in a securing mechanism 5 for securing said resistor 4 being manufactured, said mechanism having an electric contact element 6 surrounding a current output lead 7 of the frame of the resistor 4 being manufactured. The current output lead 7 of the resistor 4 being manufactured provides a galvanic contact between the electric contact element 6 and one of the ends of the wire 3, whose other end is connected with an electric contact element 8 of a wire takeup mechanism 9.

Connected to the electric contact element 6 of the mechanism 5 is the potential input of an electronic follower representing an emitter follower 10 having its output coupled to the potential input of a phase-inverting amplifier 11. The presence of a galvanic contact between the conductor of the wire 3 and the electric contact element 6, i.e. the input of the phase-inverting amplifier 11, permits measuring resistance of the unwound portion 3' of the wire 3 on the wire takeup mechanism 9 at any low frequency including a zero frequency. The output of the phase-inverting amplifier 11 is connected to the potential input of a clamping amplifier 12 and to a common junction between a pole of a reference resistor 13 and a pole of a precision voltage divider 14 composed of resistors 15 and 16. The other pole of the reference resistor 13 is connected to the electric contact element 8. The inputs of a differential amplifier 17, having a large input impedance, are connected to a common tap of the precision divider 14 and to the electric contact element 8. The output of the differential amplifier 17 is connected to the signal input of a phase-sensitive indicator 18, while the reference-signal inputs of the phase-sensitive indicator 18 are coupled to the outputs of the clamping amplifier 12. The output of the phase-sensitive indicator 18 is connected through a drive control unit 19 to a drive 20 kinematically coupled to the wire takeup mechanism 9. The zero output of the harmonic generator 1 and the zero inputs of the emitter follower 10, the phase-inverting amplifier 11, the clamping amplifier 12, and the phase-sensitive indicator 18 are connected to the other pole of the precision voltage divider 14 and to a common zero bus 21 of the device. The phase-sensitive indicator 18 indicates voltage taken from the outputs of the clamping amplifier 12.

Figure 2:
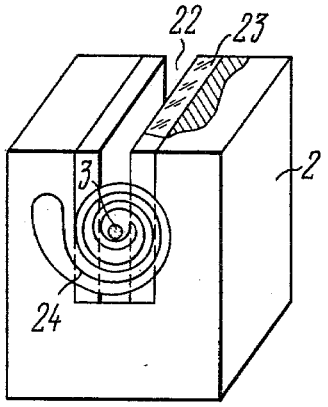
FIG. 2 depicts a current input electrode with a wire position stabilizer according to the invention.

FIG. 2 is a general view of the current input electrode 2 representing a metal bar with a groove 22. The internal surface of the groove 22 is coated with a layer 23 of insulating material, for example, glass, and is suited to pass the wire 3 forming in conjunction with the current input electrode 2 capacitive coupling between the harmonic generator 1 and the electric contact element 6 to enable application of voltage to the phase-inverting amplifier 11 whose output voltage is used to feed the measuring bridge. To fix the wire 3 in the groove 22 of the current input electrode 2, its end on the side of the wire takeup mechanism 9 (FIG. 1) mounts a position stabilizer 24 (FIG. 2) for the wire 3, said stabilizer representing a spiral. The layer 23 of suitable insulating material affords additional protection against breakdown of insulation of the wire 3 with high voltages present at the output of the harmonic generator 1.

Due to the utilization of the stabilizer 24 the capacitance formed by the current input electrode 2 and the wire 3 remains essentially constant, and the wire 3 may be easily fixed by its own movement in the groove 22, whose width does not exceed three times the diameter of the wire 3 and whose length within the electrically conductive material is 5 to 10 mm.

Figure 3:
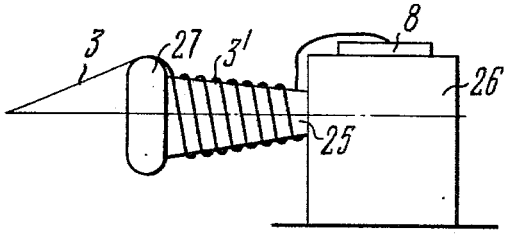
FIG. 3 shows a wire receiver of a wire takeup mechanism according to the invention.

FIG. 3 depicts the wire takeup mechanism 9 whose wire receiver 25 represents a console with a shaft passed therethrough. One end of the console is wedged in a support 26 mounting the electric contact element 8 formed with a contact area to provide a galvanic contact between the end of the wire 3 (FIG. 1) and the measuring circuit. To exclude a measuring error associated with the use of contact brushes and provide inertialess unwinding of the wire 3 precluding the strain effect in the wire 3, the free end of the wire receiver 25 (FIG. 3) mounts the wire layer representing a steel tore structure 27 with its axis of rotation kinematically linked with the drive 20 (FIG. 1).

The operation of the device for manufacturing resistors from insulated wire is based on the following principles.

Figure 4:
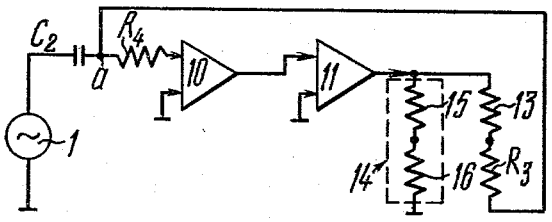
FIG. 4 is a circuit diagram illustrating operation of the device for manufacturing resistors from insulated wire in a measuring mode according to the invention.

The input impedance of any single-stage or multistage amplifier fed with parallel negative feedback is less than the total feedback resistance by the number of times equalling the gain of the amplifier. Considering that in the given case (see FIG. 4 illustrating the operation of the device in the measuring mode) the gain of the phase-inverting amplifier 11 is at least 10,000, and the total resistance $R_3$ (FIG. 4) of the portion 3' of the wire 3 (FIG. 1) wound on the wire receiver 25 (FIG. 3) and the reference resistor 13 (FIG. 4) is small (normally the resistance $R_3$ of the unwound portion 3' of the wire 3 (FIG. 1) amounts to no more than 1-2% of the resistance $R_4$ (FIG. 4) of the resistor 4 (FIG. 1) being manufactured), it is possible to neglect the resistance of the emitter follower 10 and the phase-inverting amplifier 11 and assume that the point "a" (lumped parameter of the portion of the wire 3 (FIG. 1) extending inside the current input contact 2) is shorted to ground chassis of the device. Proceeding from theory and experimental data we may consider that, in the given case, the resistance $R_3$ (FIG. 4) of the unwound portion 3' of the wire 3 (FIG. 1), the reference resistor 13 (FIG. 4), and the precision voltage divider 14 form the measuring bridge circuit whose power source is the phase-inverting amplifier 11. Turning now to FIGS. 1 and 4 it is seen that the resistor 4 being manufactured, which normally has the resistance $R_4$ (FIG. 4) as large as tens or hundreds of megohms, is not included in the measuring bridge circuit and is not, therefore, the measured resistor. Thus, its large reactance will not affect the operation of the device and the measurement results. $C_2$ is the capacitance formed by the current input electrode 2 (FIG. 1) and the wire 3.

The manufactured resistors 4 damping the voltage of the harmonic generator 1 do not have equal resistances. So, the output voltage of the phase-inverting amplifier 11 may vary within wide limits: from a minimum value or values insufficient for the highly responsive phase-sensitive indicators 18 (below 20 $\mu$V under actual conditions) to a maximum level (1 V and above). To ensure optimum operation of the phasesensitive indicator 18, it is necessary to amplify the voltage derived from the phase-inverting amplifier 17 in the first case and clamp said voltage in the second case. In the preferred embodiment of the invention the above function is performed by the clamping amplifier 12 assuring stable operating conditions for the phase-sensitive indicator 18 and, in effect, a desired accuracy in measuring the resistance of the unwound portion 3' of the wire 3.

To enhance the measuring accuracy, the differential amplifier 17 having a large input impedance is inserted at the signal input of the phase-sensitive indicator 18, said amplifier being used to prevent resistance shunting of the unwound portion 3' of the wire 3.

The accuracy in measuring the resistance of the portion 3' of the wire 3 unwound from the resistor 4 being manufactured and, thus, the accuracy of production of the resistor 4 are determined by the value of the reference resistor 13 and also by the relation existing between the values of the resistors 15, 16 and their accuracy. Therefore, the resistors 15 and 16 represent precision microwire-wound resistors, while the reference resistor 13 is a nonreactance resistance box.

The device forming the subject of the present invention operates as follows.

The resistor 4 (FIG. 1) being manufactured is placed in the securing mechanism 5 and one current output lead 7 of the resistor 4 is firmly fixed in the electric contact element 6 of the securing mechanism 5 whereby a galvanic contact will be provided between the emitter follower 10 and the wire 3. The other end of the wire 3 having no direct electrical connection with the input of the emitter follower 10 is disconnected, fitted in the current input electrode 2, and soldered to the electrical contact element 8 (FIG. 3) representing a contact area on the support 26 of the wire takeup mechanism 9.

The wire 3 (FIG. 1) is fixed by own movement in the stabilizer 24 and, hence, in the groove 22 of the current input contact 2.

Next, an external meter (not shown in FIG. 1) is used to measure the resistance of the previously wound resistor 4 being manufactured. Then, the resistance box of the reference resistor 13 is adjusted for a resistance value equalling the deviation of the value of the resistor 4 being manufactured from the rating. The measuring bridge circuit formed by the precision divider 14 (FIG. 4), the reference resistor 13, and the unwound portion 3' of the wire 3 (FIG. 1) becomes unbalanced. An unbalance signal is fed through the differential amplifier 17 to the signal input of the phase-sensitive indicator 18 and from its output to the input of the unit 19 controlling the drive 20. The control unit activates the drive 20 which rotates the tore structure 27 (FIG. 3) of the wire receiver 25 of the wire takeup mechanism 9 (FIG. 1). When the securing mechanism 5 is a rotating unit, the drive 20 will also rotate the resistor 4 being manufactured. The engagement of rubbing surfaces of the electrolyzed insulation of the wire 3 (FIG. 1) and the tore structure 27 (FIG. 3) results in that the tore structure catches the wire 3 (FIG. 1) and places it in the wire layer 25 (FIG. 3). The winding continues until the resistance $R_3$ (FIG. 4) of the unwound portion 3' of the wire 3 (FIG. 1) equals the resistance of the reference resistor 13. As this happens, the unbalance signal derived from the output of the differential amplifier 17 is not applied to the phase-sensitive indicator 18. Consequently, the unit 19 controlling the drive 20 deenergizes the drive 20, and the winding of the wire 3 is stopped. The wire 3 is cut in the middle portion of the current input electrode 2 soldered to the remaining current output lead of the resistor 4 being manufactured, and said resistor is removed from the securing mechanism 5. Since the resistance $R_3$ (FIG. 4) of the unwound portion 3' of the wire 3 (FIG. 1) is equal to the deviation of the value of the manufactured resistor 4 from the rating, the resistance of the wire 3 remaining on the manufactured resistor 4 will comply with the rating.

The table below specifies the accuracy obtained in adjusting resistors for compliance with various resistance rating in accordance with the invention.

TABLE

| Resistance rating of manufactured resistor (megohms) | 1 | 5 | 10 | 20 | 100 | 250 |
|---|---|---|---|---|---|---|
| Accuracy obtained in adjusting value of manufactured resistor (%) | 0.005 | 0.005 | 0.005 | 0.01 | 0.05 | 0.1 |

The device forming the subject of the present invention allows production of resistors over a wide range of resistance ratings with a practicable accuracy.

Industrial Use

The invention may advantageously be used in precision instrument making, radio electronic engineering, computing technology, and electrical engineering for production of precision high-megohm resistors.

We claim:

1. A device for manufacturing resistors from insulated wire comprising a take-up mechanism taking up unwound insulated wire and having electric contact elements and a drive; a securing mechanism securing a feed spool with an electric contact element; a harmonic generator; a current output electrode and a current input electrode providing capacitive coupling between a conductor of the unwound wire and said harmonic generator; a precision voltage divider; a reference resistor having a first pole connected to the electric contact element of the securing mechanism and a second pole connected to said precision voltage divider; a phase-sensitive indicator affecting said drive of said takeup mechanism and being electrically connected via its input to the contact element of the wire takeup mechanism and to a common tap of the precision divider; and a phase-inverting amplifier having an output connected to the second pole of the reference resistor and to the precision voltage divider; an electronic follower inserted between said electric contact element of said securing mechanism and a potential input of said phase-inverting amplifier; a clamping amplifier having a potential input connected to an output of the phase-inverting amplifier and an output coupled to said phase-sensitive indicator; a differential amplifier having a large input impedance and placed between a signal input of the phase-sensitive indicator and said electric contact element of said wire takeup mechanism and said precision divider; wherein the current output electrode represents a galvanic contact between the wire conductor of a resistor being manufactured and the electric contact element of the securing mechanism.

2. A device as claimed in claim 1, wherein a wire receiver of the wire takeup mechanism includes a console with a shaft passed therethrough and is rotatable in the wire receiver, the free end of the shaft mounting a wire layer formed with a tore structure.

3. A device as claimed in either of claims 1 or 2, wherein the current input electrode includes a metal bar with a groove being coated with a layer of insulation, the bar having on the side of the wire takeup mechanism a position stabilizer for the wire, said stabilizer being shaped as a spiral.

* * * * *